United States Patent [19]

Aoi

[11] Patent Number: 4,638,774

[45] Date of Patent: Jan. 27, 1987

[54] VALVE ACTUATING MECHANISM FOR INTERNAL COMBUSTION ENGINE

[75] Inventor: Kazuo Aoi, Hamamatsu, Japan

[73] Assignee: Yamaha Hatsudoki Kabushiki Kaisha, Iwata, Japan

[21] Appl. No.: 743,601

[22] Filed: Jun. 11, 1985

[30] Foreign Application Priority Data

Jun. 12, 1984 [JP] Japan ..... 59-119183

[51] Int. Cl.[4] ..... F01L 1/26

[52] U.S. Cl. ..... 123/90.22; 123/90.4; 123/90.27; 123/90.6

[58] Field of Search ..... 123/90.4, 90.22, 90.23, 123/90.27, 90.39, 90.6

[56] References Cited

U.S. PATENT DOCUMENTS

| | | | |
|---|---|---|---|
| 1,271,764 | 7/1918 | Pullinger | 123/90.22 |
| 1,306,949 | 6/1919 | Coatalen | 123/90.22 |
| 1,415,167 | 5/1922 | Fuchs | 123/90.27 |
| 1,434,188 | 10/1922 | Belden | 123/90.22 |
| 1,631,410 | 6/1927 | Fornaca | 123/90.22 |
| 1,915,237 | 6/1933 | Moore | 123/90.22 |

FOREIGN PATENT DOCUMENTS

| | | | |
|---|---|---|---|
| 186009 | 11/1982 | Japan | 123/90.27 |

*Primary Examiner*—Ira S. Lazarus

*Attorney, Agent, or Firm*—Ernest A. Beulter

[57] ABSTRACT

A valve actuating mechanism for an internal combustion engine that permits the use of a plurality of valves per combustion chamber. There are a greater number of intake valves than exhaust valves and the intake valves are actuated by means of a single rocker arm associated with a first cam shaft. The exhaust valves are individually and directly operated by a second camshaft.

6 Claims, 3 Drawing Figures

VALVE ACTUATING MECHANISM FOR INTERNAL COMBUSTION ENGINE

BACKGROUND OF THE INVENTION

This invention relates to a valve actuating mechanism for internal combustion engines and more particularly to an improved valve actuating mechanism that permits the use of plural valves for each combustion chamber of the engine.

Recently there has been a trend toward the adoption of four valve cylinder heads for high performance engines. Such engines employ two intake valves and two exhaust valves for each combustion chamber of the engine. By using a greater number of valves for a given combustion chamber configuration, it is possible to achieve larger flow areas and higher engine speeds due to the lower reciprocating mass. However, it has been thought that four valves per cylinder is the practical limit for most applications. The reason for this is that it is difficult to provide an effective actuating mechanism for more than four valves without unduly complicating the cylinder head construction, sacrificing optimum combustion chamber configuration and restricting access to the components of the engine which must be serviced, such as the spark plugs.

It is, therefore, a principal object of this invention to provide an improved valve actuating mechanism for an internal combustion engine that facilitates the use of more than four valves per chamber.

It is another object of this invention to provide an improved valve actuating mechanism for an internal combustion engine that permits the use of multiple valves while still facilitating a relatively uncomplicated cylinder head construction.

SUMMARY OF THE INVENTION

The invention is adapted to be embodied in an internal combustion engine having a cylinder head defining at least in part a combustion chamber, a set of a plurality of intake valves supported by the cylinder head for controlling the flow of an intake charge into the chamber, a set of a plurality of exhaust valves supported by the cylinder head for controlling the flow of the exhaust charge from the combustion chamber, and cam means. Means are provided for directly operating one of the sets of valves from the cam means and rocker arm means are provided for operating the valves of the other set from the cam means.

DETAILED DESCRIPTION OF THE PREFERRED EMBODIMENT

Figure 1:
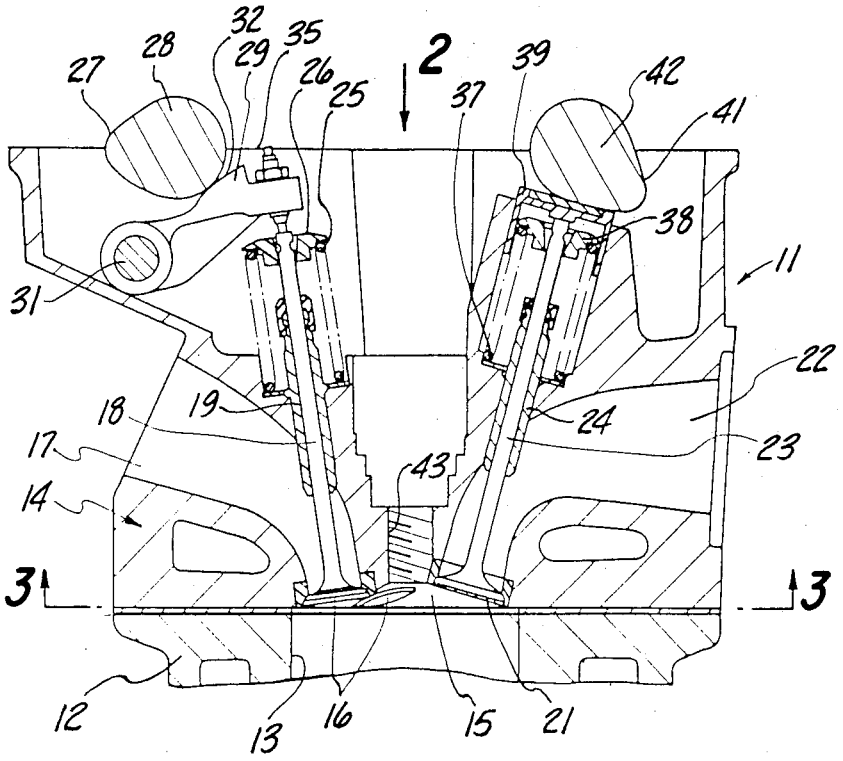
FIG. 1 is a cross-sectional view taken through a cylinder and combustion chamber of an internal combustion engine constructed in accordance with an embodiment of the invention, with portions removed.
Figure 3:
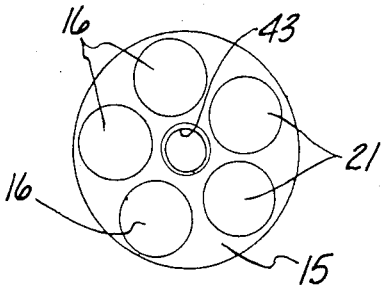
FIG. 3 is a cross-sectional view taken along the line 3—3 of FIG. 1 and shows the valve placement within the combustion chamber.
Figure 2:
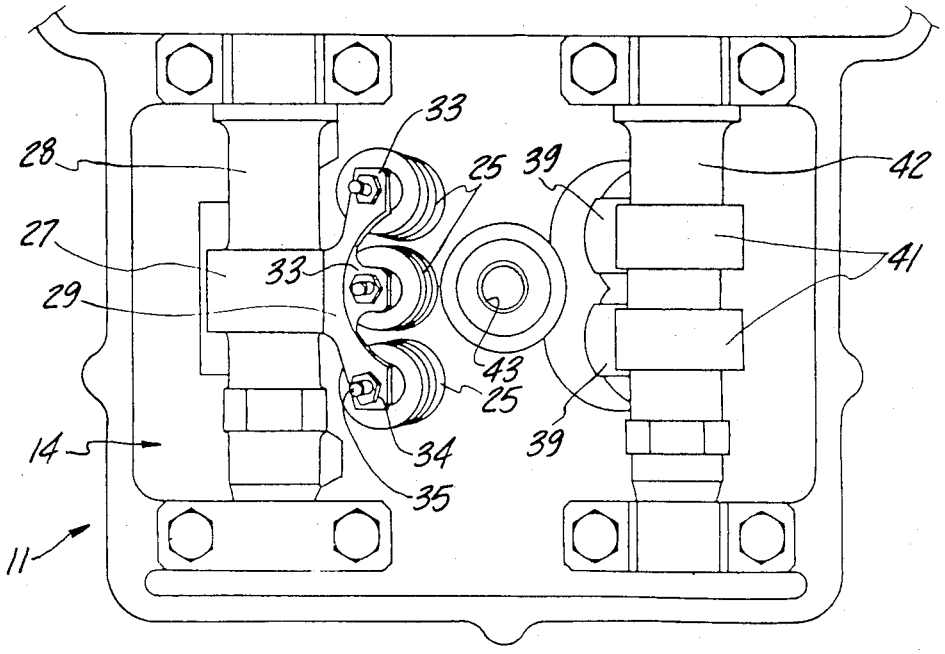
FIG. 2 is a top plan view of the cylinder head looking in the direction of the arrow 2 in FIG. 1.

In the drawings, the reference numeral 11 indicates generally an internal combustion engine constructed in accordance with a preferred embodiment of the invention. Inasmuch as the invention relates to the valve placement and valve actuating mechanism, only this portion of the engine has been illustrated in detail and only that portion which is associated with a single cylinder of the engine is illustrated and will be described. It is to be understood, of course, that the invention may be practiced with multiple cylinder engines of any configuration (i.e., inline V-type, etc.) and that the remaining unillustrated components of the engine are conventional.

The engine 11 includes a cylinder block 12 in which cylinder bores 13 are provided that reciprocally support pistons (not shown) that are coupled to a crankshaft in a known manner. A cylinder head assembly, indicated generally by the reference numeral 14, is affixed to the cylinder block 12 in a known manner and has a recess or cavity 15 that cooperates with the cylinder bore 13 and piston head so as to define the combustion chamber. As is the normal practice, the cavity 15 will, at times, be referred to as the combustion chamber.

A set consisting of a plurality of intake valves 16 are supported in the cylinder head assembly 14 and have their heads lying substantially on one side of a plane containing the cylinder bore axis. The intake valves 16 control the flow into the combustion chamber 15 through intake passages 17 formed in the cylinder head 14 and terminating at individual intake ports surrounded by valve seats with which the heads of the valves 16 cooperate. For this purpose, the intake valves 16 have stem portions 18 that are slidably supported within respective valve guides 19 pressed into the cylinder head assembly 14. In the illustrated embodiment, the set of intake valves comprises three intake valves 16.

A set of exhaust valves 21 is supported in the cylinder head assembly 14 on the side of the plane opposite to the set of intake valves 16. in the illustrated embodiment, the set of exhaust valves 21 comprises two valves that control the flow through exhaust passage 22 formed in the cylinder head assembly 14 on the side opposite the intake passages 17. Like the intake passages 17, the exhaust passages 22 terminate at respective ports surrounded by valve seats with which the heads of the exhaust valves 21 cooperate. The exhaust valves 21 have stems 23 that are slidably supported within the cylinder head 14 in pressed in valve guides 24.

The orientation of the intake valves 16 and exhaust valves 21 is particularly important in obtaining the desired combustion chamber configuration, a compact surface area and a minimum surface volume. The valve placement may be as set forth in application Ser. No. 369,665, filed Apr. 19, 1982 in the name of Yoshikawa Masaaki, entitled "Four-Cycle Engine", and assigned to the assignee of this application.

Although the valve placement and the orientation of the respective stems 18 and 23 is important, it forms no portion of this invention and for that reason reference may be had to the aforenoted copending application for a discussion of the valve placement. The invention relates to the valve actuating mechanism and that will now be described.

One difficulty with the use of multiple valves is the provision of a mechanism for actuating all of the valves that will be relatively compact in nature, permit a relatively uncomplicated cylinder head casting and yet will facilitate placement and servicing of all of the necessary components. In accordance with the invention, the set of intake valves 16 is operated by a single overhead mounted camshaft via rocker arms while the set of exhaust valves 21 is operated directly from another overhead mounted camshaft. This mechanism will now be described.

The intake valves 16 all have their stem portions 18 surrounded by respective valve springs 25 that act against valve keepers 26 and spring retainers for urging the valves 16 toward their closed position. The valves 16 are all operated in unison from a single cam lobe 27 of a first overhead camshaft 28 that is journaled in the cylinder head assembly 14 on the same side of the plane containing the cylinder bore axis on which the intake valves 16 lie. For this purpose, a rocker arm 29 is supported for pivotal movement by means of a rocker arm shaft 31 that is disposed outwardly and below the axis of rotation of the camshaft 28 and which has a follower portion 32 that is engaged with the cam lobe 27. The rocker arm 29 has individual finger portions 33 each of which carries a respective adjusting screw 34, which adjusting screws engage the tip of the respective valve stems 18 for operating them. Thus, a very compact aarrangement is provided wherein all three of the set of intake valves 16 can be operated by a single cam lobe 27.

Referring now to the exhaust valves 21, they also have their stem portions 23 surrounded by respective valve springs 37 that act against keeper retainers 38 for urging the valves 21 toward their closed positions. The cylinder head 14 is provided with respective bores in which thimble tappets 39 are slidably supported and which engage the respective tips of the valve stems 23. Each thimble tappet 39 is, in turn, engaged with a respective cam lobe 41 of an exhaust camshaft 42 that is journaled in the cylinder head assembly 14 on the same side of the plane containing the cylinder bore axis as the exhaust valves 21. Thus, the exhaust valves 21 are directly operated via the thimble tappets 39.

The camshafts 28 and 42 are driven from the engine crankshaft in any suitable manner such as by timed belts or timing chains.

The cylinder head 14 is provided with a spark plug opening 43 that is disposed substantially centrally of the cylinder bore axis and which is in a relatively unobstructed position due to the positioning and construction of the valve actuating mechanism.

It should be readily apparent from the foregoing description that the described valve actuating mechanism permits the use of plural valves per combustion chamber and a relatively simple and highly effective actuating mechanism for the valves. The valves having the greatest number are operated by rocker arms while the valves having the lesser number are operated directly via thimble tappets.

Although an embodiment of the invention has been illustrated and described, various changes and modifications may be made without departing from the spirit and scope of the invention, as defined by the appended claims.

I claim:

1. In an internal combustion engine having a cylinder head defining at least in part with a cylinder bore a combustion chamber, a set of a plurality of intake valves supported by said cylinder head at one side of a plane containing the axis of said cylinder bore for controlling the flow of an intake charge into said combustion chamber, a set of a plurality of exhaust valves supported by said cylinder head at the other side of said plane for controlling the flow of the exhaust charge from the combustion chamber, first and second cam means disposed on opposite sides of said plane, means for directly operating the valves of one of said sets from said first cam means, and rocker arm means for operating the valves of the other set from said second cam means.

2. In an internal combustion engine as set forth in claim 1 wherein the first cam means comprises a first camshaft associated with the rocker arm means and the second cam means comprises a second camshaft associated with the directly operated valves.

3. In an internal combustion engine as set forth in claim 2 wherein the rocker arm means comprises a single rocker arm associated with a single cam lobe and having a plurality of finger portions each engaged with a respective one of the valves.

4. In an internal combustion engine as set forth in claim 1 wherein one of the valve sets has a greater number of valves than the other of the valve sets.

5. In an internal combustion engine as set forth in claim 4 wherein the set of valves having the greater number is operated by the rocker arm means and the valves of the other set are directly actuated.

6. In an internal combustion engine as set forth in claim 5 wherein the rocker arm means comprises a single rocker arm engaged with a single cam lobe and having a plurality of finger portions each associated with a respective one of the valves of the set.

* * * * *